US006077563A

United States Patent [19]

Kapp et al.

[11] Patent Number: 6,077,563

[45] Date of Patent: Jun. 20, 2000

[54] OVERPRINTABLE THERMOSET DECORATING INKS AND METHOD OF APPLICATION

[75] Inventors: David C. Kapp, Gibsonia; Howard M. Lindberg, McKeesport, both of Pa.

[73] Assignee: Cerdec Corporation, Washington, Pa.

[21] Appl. No.: 09/188,464

[22] Filed: Nov. 9, 1998

Related U.S. Application Data

[60] Provisional application No. 60/065,282, Nov. 10, 1997.

[51] Int. Cl.[7] ..... B05D 1/32; B05D 1/36; B05D 3/02

[52] U.S. Cl. ..... 427/258; 427/261; 427/267; 427/269; 427/280; 427/282; 427/287; 427/374.3; 427/379; 427/389.7; 427/393.6

[58] Field of Search ..... 427/374.1, 374.2, 427/374.3, 379, 389.7, 393.6, 258, 269, 282, 287, 261, 267, 280

[56] References Cited

U.S. PATENT DOCUMENTS 5,202,162 4/1993 Hart, Jr. et al. .
5,346,933 9/1994 Knell .
5,549,929 8/1996 Scheibelhoffer et al. .

*Primary Examiner*—Erma Cameron
*Attorney, Agent, or Firm*—Alan G. Towner; Eckert Seamans Cherin & Mellott, LLC

[57] ABSTRACT

Overprintable thermoset decorating inks and methods of applying such inks to substrates are disclosed. The decorating inks include a reactive polymeric binder resin and a crystalline crosslinker. The reactive polymeric binder resin may comprise acrylics, epoxies, polyesters, urethanes and the like which possess high Tg values. The combination of high glass transition temperature resins and crystalline crosslinkers avoids the necessity of using diluents in the coating compositions. The coating composition is applied to a substrate by heating the composition to a first temperature below the curing temperature of the coating, applying the heated coating composition to the substrate, allowing the applied coating composition to cool sufficiently so it at least partially hardens, and heating the applied coating composition to a second temperature above the first temperature for a sufficient to cure the coating composition. In a preferred embodiment, at least one additional coating layer is applied to the initial cooled coating composition prior to the curing step.

15 Claims, No Drawings

OVERPRINTABLE THERMOSET DECORATING INKS AND METHOD OF APPLICATION

CROSS REFERENCE TO RELATED APPLICATION

This application claims the benefit of U.S. Provisional Application Ser. No. 60/065,282 filed Nov. 10, 1997.

FIELD OF THE INVENTION

The present invention relates to decorating inks, and more particularly relates to overprintable thermoset decorating inks and methods of applying such inks to substrates.

BACKGROUND INFORMATION

Thermoplastic organic overprint inks are known in the art. The ability of such inks to accept an overprint of two or more contrasting colored inks prior to curing gives manufacturing advantages in that only a single curing step is needed to cure the multiple colors. Glass and ceramic articles, for example glass bottles, are typically decorated by screen printing. The decorating inks must be fluid and readily transferred through the screen mesh, yet set up quickly enough so second or third prints can be applied without distorting or smearing the earlier layers.

U.S. Pat. No. 5,202,162 to Hart Jr. et al. discloses a blend of thermoplastic materials that permit overprinting, but such compositions are not suited to articles that may be subjected to elevated temperatures after decorating, since the composition retains its thermoplastic nature and softens and/or becomes liquid when reheated.

Thermoset systems have been used to produce an irreversible change of state and produce cured materials which remain hard and resistant even at elevated temperatures. U.S. Pat. No. 5,346,933 to Knell discloses a blend of crystalline epoxy resin, crystalline curing agent, and either crystalline or liquid diluents to produce a composition that is screen printable at elevated temperatures, then is thermally cured to its final properties at higher temperatures. U.S. Pat. No. 5,549,929 to Scheibelhoffer discloses the use of crystalline resins and a crosslinker in conjunction with a crystalline diluent to produce compositions that are screen printable at elevated temperature and curable at higher temperatures. Both U.S. Pat. Nos. 5,346,933 and 5,549,929 stress the importance of using a diluent to reduce the viscosity of the ink for screen printing at elevated temperature, prior to the final cure. In addition, Scheibelhoffer discusses the need to use a diluent in order to yield a coating that does not have excessively high viscosity at application. The present invention obtains printable compositions without the need of a diluent.

SUMMARY OF THE INVENTION

An aspect of the present invention is to provide a method of decorating a substrate. The method includes the steps of providing a coating composition comprising a reactive polymeric binder and a crystalline crosslinker, heating the coating composition to a first temperature below the curing temperature of the curing composition at which the coating composition is fluid, applying the heated coating composition to a substrate, allowing the applied coating composition to cool sufficiently so it at least partially hardens, and heating the applied coating composition to a second temperature above the first temperature for sufficient time to cure the coating composition.

Another aspect of the present invention is to provide an overprintable thermoset coating composition including a reactive polymeric binder resin and from about 20 to about 80 weight percent of a crystalline crosslinker.

These and other aspects of the present invention will be more apparent from the following description.

DETAILED DESCRIPTION

The present invention utilizes a crystalline crosslinker in conjunction with a reactive polymeric binder having a relatively high glass transition temperature (Tg) to prepare hard overprintable thermally curable compositions used for decorating substrates such as glass and ceramic surfaces. The use of crystalline crosslinkers produces screen printable compositions that will readily accept an overprint prior to curing. Small but effective amounts of conventional liquid crosslinkers, including methylated, ethylated, or butylated melamines, benzoguanamines, ureas, or glycolurils, and the like, may optionally be included to modify the printing characteristics of the present compositions.

As used herein, the term "reactive polymeric binders" means high Tg or crystalline resins capable of forming a covalent bond with crosslinking resins upon the application of a sufficient amount of heat to initiate a chemical reaction. Examples of such binders include resins such as acrylics, epoxies, polyesters, urethanes and the like. Specific commercially available examples include Rucote 102 from Ruco Polymers, Epon 1001F from Shell, and Fine-Clad M-8027 from Reichhold. The reactive polymeric binders preferably have Tg values of greater than about 30° C., more preferably greater than 45° C.

The present invention eliminates the need for a diluent by using a crystalline crosslinker that can be used in amounts sufficient to produce a screen printable composition with suitable polyester, acrylic, epoxy and urethane resins and the like, which are fluid and stable at temperatures necessary for screen printing, and which are the thermally curable to hard, resistant films. Suitable crystalline crosslinkers include tetramethoxymethyl glycoluril and blocked crystalline isocyanurates. Particular examples of such crosslinkers are tetramethoxymethyl glycoluril sold under the designation Powderlink 1174 by Cytec Industries and caprolactam blocked isophorone diisocyanurate sold under the designation Rucote NI-2 by Ruco Polymer.

In accordance with a preferred embodiment of the present invention, the overprintable composition comprises from about 20 to about 80 weight percent of a crystalline crosslinker, more preferably from about 35 percent to about 55 weight percent, in conjunction with a high Tg or crystalline resin capable of forming a covalent bond with the crosslinker. The optional liquid crosslinker may comprise from about 2 to about 80 weight percent of the crystalline crosslinker, more preferably from about 15 to about 25 weight percent. Various inorganic and/or organic pigments may be incorporated into the formulation for the purpose of obtaining a colored and/or opaque film. Additives which are commonly used in the art, such as surfactants, flow agents, adhesion promoters, and catalysts may also be used to enhance to properties of the final films. Small amounts of flow agents can be used in conjunction with the invention in order to improve gloss or relieve surface defects. The present compositions are preferably substantially free of diluents.

TABLE 1

| Ink Compositions (Weight Percent) Composition No. 1 | |
|---|---|
| Rucote 102 binder (Ruco Polymer) | 36.8% |
| Powderlink 1174 crosslinker (Cytec Industries) | 47.9% |
| Anti-Terra U-100 dispersant (Byk-Chemie) | 0.1% |
| DPP Red pigment (Ciba Pigments) | 8.7% |
| Cabosil TS720 rheological aid (Luzenac) | 3.1% |
| Masil 750 wetting aid (BASF) | 1.0% |
| A-187 adhesion promoter (OSI, Inc.) | 2.1% |
| Nacure 5225 catalyst (King Industries) | 0.3% |

| Composition No. 2 | |
|---|---|
| Rucote 102 binder (Ruco Polymer) | 34.6% |
| Powderlink 1174 crosslinker (Cytec Industries) | 34.6% |
| PE400 flow aid (Dow Chemical) | 4.0% |
| BYK 163 dispersant (Byk-Chemie) | 1.4% |
| R-902 $TiO_2$ pigment (DuPont) | 19.7% |
| Cabosil TS720 rheological aid (Luzenac) | 2.5% |
| Masil 750 wetting aid (BASF) | 1.4% |
| A-187 adhesion promoter | 1.6% |
| Nacure 5225 catalyst (King Industries) | 0.2% |

| Composition No. 3 | |
|---|---|
| Rucote 102 binder (Ruco Polymer) | 36.0% |
| Powderlink 1174 crosslinker (Cytec Industries) | 40.8% |
| Cymel 303 liquid crosslinker (Cytec Industries) | 10.0% |
| Anti-Terra U-100 dispersant (Byk-Chemie) | 0.1% |
| DPP red pigment (Ciba Pigments) | 7.8% |
| Cabosil TS720 rheological aid (Luzenac) | 1.9% |
| Masil 750 wetting aid (BASF) | 1.5% |
| A-187 adhesion promoter (OSI, Inc.) | 1.7% |
| Nacure 5225 catalyst (King Industries) | 0.2% |

The present compositions may be heated to a point, preferably within a temperature range of from about 80 to about 130° C., at which they become fluid and can be applied to a suitable substrate by screen printing, yet are still below the point at which cure takes place. Upon cooling, the applied film becomes hard and can be overprinted with a second color of suitable composition, and, after cooling, a third color, etc. When the final design is achieved, the multiple layers are preferably thermally cured by a single application of heat at a typical temperature of from about 170 to about 240° C. Similarly, the final ink application may be a conventional liquid organic ink.

The present inks may be screen printed onto substrates such as glass, ceramic and metal, for example, by high speed automatic or semi-automatic decorating machines that are conventionally used in the glass and ceramic industries. The ink is applied through the screen mesh by the passage of a squeegee, and adheres to the surface of the article being decorated. In multiple color printing, the article then passes to a second printing station where a second color is applied, which may partially or completely overlay the first color, and so on, with up to seven colors being applied in typical commercial applications. The printed decoration can then be cured by application of heat sufficient to provoke the crosslinking reaction and produce the final cured film. An advantage of the present invention is that the first color solidifies quickly enough to provide a stable printing surface for subsequent color printing, allowing multiple colors to be overlaid yet remaining fluid enough at the screen temperatures to permit high speed printing.

Whereas particular embodiments of this invention have been described above for purposes of illustration, it will be evident to those skilled in the art that numerous variations of this details of the present invention may be made without departing from the invention as defined in the appended claims.

What is claimed is:

1. A method of decorating a substrate comprising:

providing a thermosettable coating composition comprising a reactive polymeric binder and from about 20 to about 80 weight percent of a crystalline crosslinker, wherein the coating composition is substantially free of diluents;

heating the coating composition to a first temperature below a curing temperature of the coating composition at which the coating composition is fluid and the crystalline crosslinker is substantially inactive;

applying the heated coating composition to a substrate;

allowing the applied coating composition to cool sufficiently so it at least partially hardens; and heating the applied coating composition to a second temperature above the first temperature for sufficient time to activate the crystalline crosslinker and cure the coating composition.

2. The method of claim 1, wherein the reactive polymeric binder comprises at least one resin selected from the group comprising acrylics, epoxides, polyesters and urethanes.

3. The method of claim 1, wherein the crystalline crosslinker comprises at least one material selected from the group comprising tetramethoxymethyl glycoluril and isocyanurates.

4. The method of claim 1, wherein the crystalline crosslinker comprises from about 35 to about 55 weight percent of the coating composition.

5. The method of claim 1, wherein the crystalline crosslinker comprises from about 2 to about 80 weight percent of a liquid crosslinker.

6. The method of claim 1, wherein the first temperature is from about 80 to about 130° C.

7. The method of claim 1, wherein the second temperature is from about 170 to about 240° C.

8. The method of claim 1, further comprising applying the heated coating composition to the substrate in liquid form.

9. The method of claim 1, further comprising applying the heated coating composition is applied to the substrate by screen printing.

10. The method of claim 1, wherein the substrate comprises glass or ceramic.

11. The method of claim 1, further comprising:

applying at least one additional coating to the cooled coating composition prior to the curing of the coating composition.

12. The method of claim 11, wherein the at least one additional coating is a different color than the coating composition.

13. The method of claim 11, wherein the at least one additional coating comprises a reactive polymeric binder and from about 20 to about 80 weight percent of a crystalline crosslinker.

14. The method of claim 11, wherein the at least one additional coating comprises a liquid organic ink.

15. The method of claim 11, further comprising applying the at least one additional coating is applied by screen printing.

* * * * *